United States Patent [19]

Gliha

[11] Patent Number: 4,932,900

[45] Date of Patent: Jun. 12, 1990

[54] ELECTRICAL CONNECTOR WITH REAR REMOVABLE CIRCUIT ELEMENTS

[75] Inventor: Edward R. Gliha, Bainbridge, N.Y.

[73] Assignee: Amphenol Corporation, Wallingford, Conn.

[21] Appl. No.: 410,049

[22] Filed: Aug. 8, 1989

Related U.S. Application Data

[63] Continuation of Ser. No. 926,598, Nov. 3, 1986, abandoned.

[51] Int. Cl.[5] ..... H01R 13/00

[52] U.S. Cl. ..... 439/608

[58] Field of Search ..... 439/607-610

[56] References Cited

U.S. PATENT DOCUMENTS

| | | | |
|---|---|---|---|
| 3,825,874 | 7/1974 | Peverill | 439/608 |
| 4,655,532 | 4/1987 | Hillis et al. | 439/607 |
| 4,678,260 | 7/1987 | Gallusser et al. | 439/607 |

*Primary Examiner*—Joseph H. McGlynn
*Attorney, Agent, or Firm*—Bacon & Thomas

[57] ABSTRACT

A connector assembly allows rear repair/replacement of monolithic capacitors as a result of a frictionally mounted insert assembly being retracted from the rearward end portion of the shell.

9 Claims, 2 Drawing Sheets

ELECTRICAL CONNECTOR WITH REAR REMOVABLE CIRCUIT ELEMENTS

This is a continuation of Ser. No. 926,598filed Nov. 3, 1986, now abandoned.

This invention relates to an electrical connector with rear removable circuit elements.

In some applications electrical circuits need protection from electromagnetic interference (EMI) and transient signals such as electromagnetic pulses, lightning, and other voltages having pulses of extremely short duration and high amplitudes. Typically the circuit protection is permanently encapsulated within the connector shell.

In some applications fragile monolithic capacitors are disposed in the connector shell, each capacitor having an array of apertures for passing an electrical contact and completing an electrical ground path from the contacts to the connector shell. Although these capacitors are very expensive should they become damaged in some way it would be desirable to be able to replace the capacitor without discarding the entire connector. Frequently these capacitors are separately stocked whereas the connector to which they are fitted are not separately stocked and may require months to reorder. Accordingly a need arises for circuit protection elements to be removable from its connector either for repair or possibly for replacement whereby to change the circuit protection elements provided in that connector.

An electrical connector assembly includes a hollow cylindrical metal shell having a forward and a rearward end portion, a dielectric insert having an array of first passages therethrough each receiving an electrical first contact, filter means for filtering signals passing through the contacts, grounding means for grounding the contacts to the shell, and mounting means for mounting the grounding means and the filter means in the shell.

The connector assembly is particularly characterized by the filter means comprising a pair of axially spaced, removable, planar monolithic capacitors each having an active electrode for electrical connection to the contacts and a ground electrode, the grounding means comprising a removable metal annular grounding spring for electrically interconnecting the ground electrodes to the shell, and the mounting means comprising a removable insert assembly. The monolithic capacitors are removable from the rearward end portion of the shell upon removal of the insert assembly.

The mounting means comprises the insert assembly including a dielectric body having a like array of second passages extending therethrough each second passage capable of carrying an electrical second contact for mating with a respective first contact, securing means for removably securing the insert assembly into the rearward end portion of the shell, and means for aligning the insert assembly with the insert so that the first and the second contacts of each array are aligned with one another for mating.

Advantageously such an electrical connector allows capacitors to be removed from the rearward end portion of the shell either for repair or for replacement.

The invention will now be described, by way of example, with reference to the following drawings in which.

Figure 1:
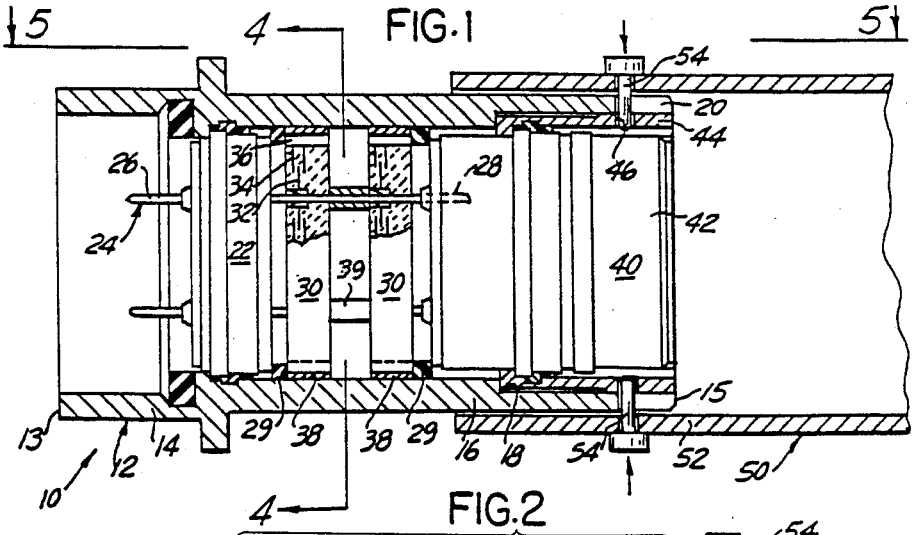
FIG. 1 is an elevation view in section of the assembled electrical connector showing a removal tool being received over the rearward end portion of the connector shell.

Turning now to the drawings, FIG. 1 shows an electrical connector assembly 10 including a hollow cylindrical metal shell 12, a dielectric insert 22, an array of first contacts 24 carried in the insert, a pair of removable planar monolithic capacitors 30, a pair of seals 29, a ferrite sleeve 39 disposed around each first contact, and a removable dielectric insert assembly 40 carrying an array of second contacts (not shown). The shell 12 has a forward and rearward end portion 14, 16 each terminating in a respective end face 13, 15 with the forward end portion 14 being configured for mating with another connector shell (not shown). The rearward end portion 16 has an axial cutout 20 extending inwardly from end face 15.

The dielectric insert 22 is nonremovably mounted in the shell and includes an array of through passages each receiving one first contact 24.

The first contact 24 is axially elongated and includes a mating forward portion 26 and a mating rearward end portion 28, each first end portion extending from the insert 22 with the forward end portion 26 for mating with a contact in the mating shell and the rearward end portion 28 for mating with a second contact. As shown the mating end portions 26, 28 are formed into a pin for mating with a socket type contact.

A filter arrangement includes a pair of axially spaced, removable, apertured planar monolithic capacitors 30 each having an active electrode 32 for electrical connection to the first contacts 24 received in respective of its apertures and a ground electrode 34 terminating on its outer circumference. Each monolithic capacitor is cylindrical and includes a pair of radial notches 36 in its outer periphery such that when the capacitor is inserted into the shell the notches are adjacent to the inner wall of the shell whereby to permit passage of a retraction tool 60 which seats behind the capacitor to pull the capacitor outwardly from the shell.

A ferrite sleeve 39 encircles each first contact 24 and is disposed between each monolithic capacitor 30 to space the capacitors axially apart from one another and form the inductive element for the filter.

A grounding plane is defined by an annular metal grounding spring 38 which is interposed between the outer periphery of the capacitor and the inner wall of the shell to complete an electrical circuit path therebetween (i.e., the connector ground).

A pair of annular seals 29 each of a soft elastomeric material are provided to absorb shock and adjust for axial tolerances, one seal being interposed between the dielectric insert 22 and the capacitor nearest thereto and the other seal being interposed between the insert assembly 40 the capacitor nearest thereto.

The insert assembly 40 includes a dielectric member 42 and a metal sleeve 44, the member having a like array of second passages 45 extending therethrough each, second passage carrying an electrical second contact 47 for mating with a respective first contact and the sleeve including a radial recess 46 adapted to be aligned with the cutout 20.

The insert assembly is removably secured in the rearward end portion of the shell as a result of the sleeve 44 having an outer periphery sized to interference fit in the rearward end portion of the shell. As shown, the rearward end portion 16 is stepped at 18.

An alignment arrangement includes an appropriate key and keyway being provided on the sleeve and the shell (not shown) whereby to align the slot with its cutout and the first and second contacts.

An arrangement for removing the insert assembly 40 from the shell includes an axial cutout in the rearward end portion of said shell and a radial recess in the insert member, alignment of the recess and slot allowing a peg to be inserted through the cutout and into the recess whereby rearward movement of the peg will pull the insert assembly rearwardly. While the axial cutout is shown terminating on the rearward end face of the shell, the axial cutout could terminate inwardly of the rearward end face of the shell to define a limit on rearward retraction movement of the insert assembly.

A retraction tool 50 comprising a tubular sleeve 52 is sized to clearance fit over the rearward end portion of the shell. A pair of pegs 54 are positioned so as to insert within the axial cutout 20 and radial recess 46, rearward movement of the tool retracting the insert assembly from its interference fit in the shell.

Figure 2:
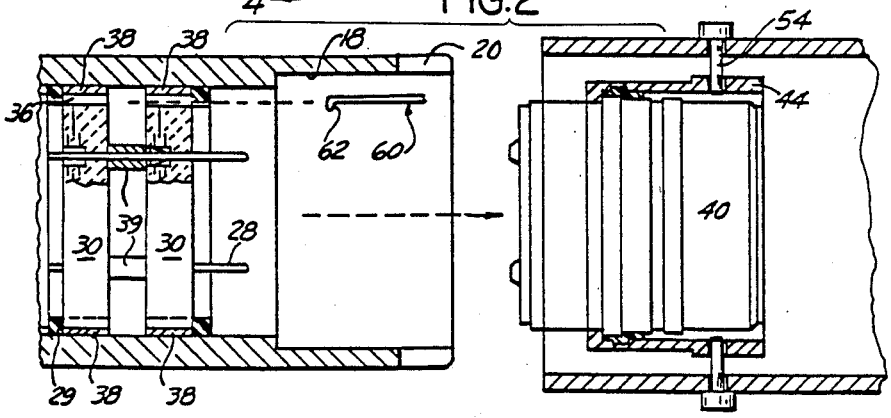
FIG. 2 is a partial elevation view in section showing disassembly of the connector assembly.

FIG. 2 shows the insert assembly 40 retracted from the shell. A tool 60 (shown in fragment) includes an inward tooth 62 sized to fit in the notch 36 and seat behind the capacitor 30.

Figure 3:
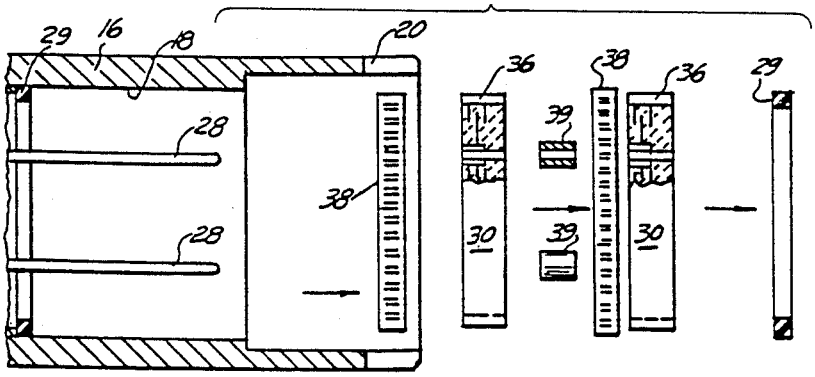
FIG. 3 shows further disassembly of the connector assembly.

FIG. 3 shows the capacitors 30, the rearwardmost seal 29, the ferrite sleeves 39 and grounding springs being removed from, the connector shell following rearward removal of the insert assembly 40.

Figure 4:
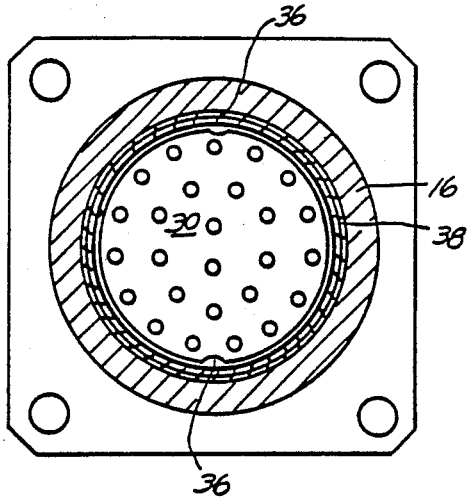
FIG. 4 shows an interior view of the connector assembly taken along lines 4—4 of FIG. 1 and a monolithic capacitor therein.

FIG. 4 shows a capacitor 30 in the rearward end portion 16 of the shell, the notches 36, and the grounding spring 38.

Figure 5:
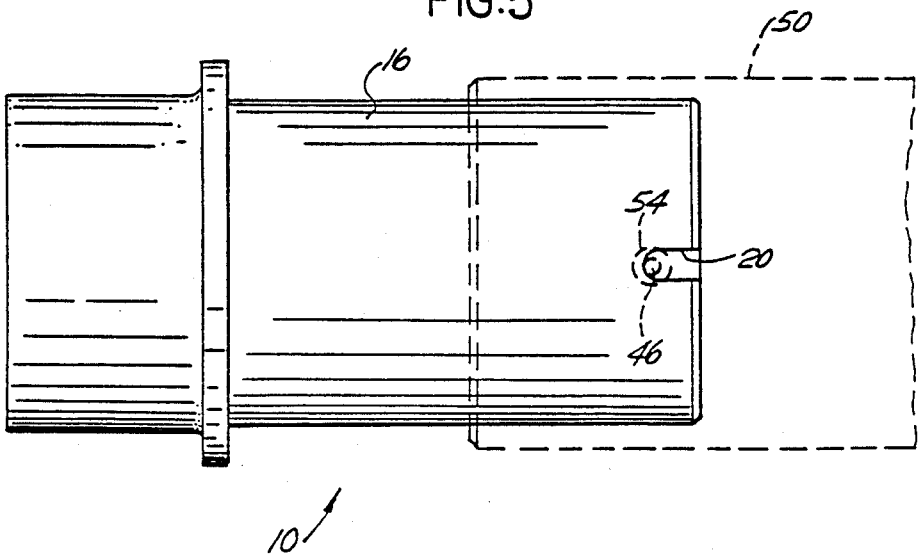
FIG. 5 shows a removal tool being received over the rearward end portion of the connector assembly taken along lines 5—5 in FIG. 1.

FIG. 5 shows a side view of the connector assembly with the tool 50 being shown in phantom positioned about the axial cutout and radial recess.

Having described the invention what is claimed is:

1. An electrical connector assembly comprising a hollow cylindrical metal shell having a forward and a rearward end portion, a dielectric insert having an array of first passages therethrough each receiving an electrical first contact, filter means for filtering signals passing through the contacts, grounding means for grounding the contacts to the shell, mounting means for mounting the grounding means and the filter means in the shell and removal means for removing the mounting means from the shell, wherein said filter means comprises a pair of axially spaced, removable, planar monolithic capacitors each having an active electrode for connection to the contacts and a ground electrode, said grounding means comprise a pair of removable metal annular grounding springs for interconnecting the ground electrodes to the shell, said mounting means comprises a removable, second dielectric insert having a like array of second passages extending therethrough each second passage carrying an electrical second contact for mating with a respective first contact, securing means for removably securing the second dielectric insert into the rearward end portion of the shell comprising an insert member having an outer periphery sized to interference fit in the rearward end portion of the shell, and means for aligning the second dielectric insert with the first dielectric insert so that the arrays are aligned with one another, said monolithic capacitors being removable from the rearward end portion of the shell upon removal of the insert assembly, and said removal means comprises an axial cutout in the rearward end portion of said shell and a radial recess in the insert member, alignment of the recess and axial cutout allowing a peg to be inserted through the cutout and into the recess whereby rearward movement of the peg will pull the second dielectric insert rearwardly.

2. The connector assembly as recited in claim 1 including resilient means spacing the monolithic capacitors from the dielectric inserts for absorbing shock.

3. The connector assembly as recited in claim 1 wherein the first contacts are nonremovably mounted in the first electric insert each including a mating forward and rearward end portion with the mating rearward end portion completing an electrical interconnection with respective second contact in the second dielectric insert.

4. The electrical connector assembly as recited in claim 3 wherein a ferrite sleeve encircles each first contact and is disposed between each monolithic capacitor.

5. The electrical connector assembly as recited in claim 4 wherein each monolithic capacitor is cylindrical and includes at least one radial notch its its outer periphery adjacent to the inner wall of the shell whereby to permit passage of a retraction tool to pull the capacitor outwardly from the shell.

6. In an electrical connector assembly, a dielectric insert having a plurality of first contacts each having a rearward end portion disposed interiorly of the shell, a pair of planar apertured monolithic capacitors each removably disposed in the shell with respective of its apertures receiving an electrical contact, grounding means completing an electrical path to the capacitor for grounding the contacts to the shell, resilient dielectric means for axially spacing the capacitors from one another, insert means for removably captivating the capacitors in the shell, and removal means for removing the insert means from the shell whereby the capacitors may also be removed from the shell.

7. In an electrical connector having a hollow cylindrical shell, an apertured monolithic capacitor in the shell, a dielectric insert mounted in the shell and having a plurality of electrical contacts each in electrical circuit relation with the capacitor and the shell, and an insert assembly mounted in the rearward end portion of the shell for retaining the capacitor in the shell, the improvement comprising access means for providing access to the capacitor whereby it may be removed from the shell, the access means comprising the insert assembly being interference fit in the shell, the rearward end portion of the shell having an axial cutout, and the insert assembly having a radial recess adapted to be registered with the cutout for receiving a peg inserted therethrough, radial insert of the peg into the recess and rearward movement pulling the insert assembly outwardly from the shell.

8. The electrical connector as recited in claim 7 wherein the axial cutout terminates on the rearward face of the shell.

9. The electrical connector as recited in claim 7 wherein the axial cutout terminates inwardly of the rearward end face of the shell to define a limit on rearward movement of the retraction movement of the insert assembly.

* * * * *